United States Patent [19]

Rehbein

[11] 4,335,548

[45] Jun. 22, 1982

[54] INSULATING SKIRT

[75] Inventor: Erwin G. Rehbein, Waupaca, Wis.

[73] Assignee: Millcraft Housing Corp., Waupaca, Wis.

[21] Appl. No.: 144,251

[22] Filed: May 19, 1980

[51] Int. Cl.[3] ..... E02D 31/00

[52] U.S. Cl. ..... 52/169.11

[58] Field of Search ..... 52/309.8, 309.4, 169.11, 52/169.12, 309.1, 573, 404, 406, 576, 396; 404/48, 47, 49, 51, 68, 58, 59

[56] References Cited

U.S. PATENT DOCUMENTS

| | | | |
|---|---|---|---|
| 2,743,602 | 5/1956 | Dunn | 52/169.11 |
| 3,040,411 | 6/1962 | Messenger | 52/169.11 |
| 3,238,856 | 3/1966 | Jahn | 404/68 |
| 3,403,488 | 10/1968 | Davidson | 52/404 |
| 3,435,580 | 4/1969 | Merrill | 52/576 |
| 3,561,175 | 9/1971 | Best | 52/169.11 |
| 3,704,562 | 12/1972 | Grants | 52/405 |
| 3,753,323 | 8/1973 | Nesbitt | 52/169.12 |
| 3,841,041 | 10/1974 | Friedland | 52/169.11 |
| 3,854,260 | 12/1974 | O'Hanlon | 52/309.8 |
| 3,866,373 | 2/1975 | Hudock | 52/309.1 |
| 3,961,454 | 6/1976 | Adams | 52/404 |
| 4,034,528 | 7/1977 | Sanders | 52/404 |
| 4,050,206 | 9/1977 | Utsuyama | 404/64 |
| 4,195,456 | 4/1980 | Hickman | 52/404 |

FOREIGN PATENT DOCUMENTS

| | | | |
|---|---|---|---|
| 970582 | 7/1975 | Canada | 52/169.11 |
| 2043030 | 4/1971 | Fed. Rep. of Germany | 52/169.11 |
| 1138882 | 1/1969 | United Kingdom | 52/309.8 |

*Primary Examiner*—John E. Murtagh

*Attorney, Agent, or Firm*—Russell L. Johnson

[57] ABSTRACT

A foundation insulating skirt comprising a sheet of insulating material to be placed in contact with the outside perimeter of a foundation, and an outer protective shield for the panel. The protective shield is configured so as to cover the top edge and the outside surface of the sheet. The invention has utility as an insulating skirt for the outside of the footings of floating slab constructions and the like. An embodiment of the invention may be employed as the outer pouring form for said footings thereafter the form is left in place, as an integral part of the footing. The insulating skirt is at least in part held in place by the earth which is back filled against the footing and which bears against and supports the lower portion of the insulating skirt.

4 Claims, 4 Drawing Figures

INSULATING SKIRT

BACKGROUND OF THE INVENTION

It has long been known that in floating slab constructions and the like there are appreciable heat losses due to conduction of heat through the footings to the surrounding soil and air. Efforts to insulate the outside perimeters of such footings have been frustrated by the fact that in conventional constructions a part of the footings is above ground and a part is below ground. A successful insulator for the outside perimeter of such footings must be substantially a permanent installation which is capable of withstanding a wide range of destructive forces over a long period of time. A brief listing of such destructive forces would include solar degradation, thermal forces above and below ground, chemical agents above and below ground, a variety of mechanical forces both intermittent and continuous, attack by bioagents and invasion by worms, grubs, roots and the like. The successful insulator must also be economical to manufacture and convenient and economical to install.

It therefore is an object of this invention to provide a panel for an insulating skirt for the outside perimeter of foundations and footings and the like which becomes substantially a permanent part of the structure to which it is applied.

It is further an object of this invention to provide a panel for an insulating skirt as described above which will withstand the destructive forces to which it will be exposed for very long periods of time without appreciable degradation.

It is further an object of this invention to provide a panel for an insulating skirt as described above wherein the panel is composed of a sheet of substantially rigid insulating material and a tough and durable outer protective shield.

It is still further an object of the invention to provide a panel as described above wherein the top portion of the panel is attachable to the structure and the bottom part of the panel is held in place and supported by the earth which is backfilled against the lower portion of the panel.

It is yet another object of the invention to provide a panel as described above which is very low cost to manufacture and economical, convenient and versatile in its many uses.

DISCUSSION OF THE PRIOR ART

The insulation of the outer perimeter of footings and foundations is not new in the art. Present practice involves the steps of; sealing the footing or foundation, applying insulation to the outside perimeter of the footing or foundation by the use of mastic or the like, and then providing an outer protective coating to the insulation. These multiple steps are time consuming and frequently do not produce satisfactory results. Many of the problems associated with this method of providing exterior insulation to foundations and footings are found to arise due to the different conditions found below grade as compared to those found above grade.

U.S. Pat. No. 979,310 to Kammerer teaches the direct application of an insulating panel having an outer protective means to an exterior wall. Mr. Kammerer's invention makes known the concept of applying to an outer wall a panel comprising a sheet of substantially rigid insulating material having a protective outer coating. U.S. Pat. No. 3,906,693 to Todorovic teaches improvements in that concept.

U.S. Pat. No. 2,038,967 to Strong teaches the use of a sheet of substantially rigid insulating material which is insertible in a mating protective form thereby in 1936, making available to the construction industry the concept of a sheet of substantially rigid insulating material being provided with a mating protective shield. U.S. Pat. No. 3,209,503 to Mustuller shows a more recent adoption of this concept to a curtain wall assembly.

U.S. Pat. No. 2,978,840 to Tatch teaches the incorporation of sheets of substantially rigid insulating materials directly into the concrete structure to become an integral part of the finished structure, thereby in 1961, providing this concept to the art.

While some of the concepts embodied in the present invention are found in the prior art and the problems to be solved by this invention are well known in the art, the application of said concepts to the solution of said problems in the manner taught by the present invention is not found in the prior art. In particular this prior art does not provide a means for satisfactorily dealing with the problems of providing outer wall protection continuously both above and below ground. Nor does the prior art provide a foundation wall insulating means which is simple in construction, economical to fabricate, convenient, and economical to install, and durable in use. The specific means by which this invention provides the above discussed novelty is described in detail hereinafter.

BRIEF DESCRIPTION OF THE INVENTION

The invention in its simplest form comprises a sheet of substantially rigid insulation material which is liquid impervious such as expanded polystyrene, (Styrofoam R) or the like, and an outer protective shield of a tough and durable material such as a reinforced thermosetting plastic (fiberglass).

The sheet of insulation is joined with the shield. The sheet of insulation may be simply adhered to the shield by using an appropriate adhesive or in a more sophisticated embodiment the shield is fabricated so as to provide a receiving channel for the sheet of insulation.

The assembled panel is placed in position and may be adhered to the outside wall of the structure by using mastic or the like. The top of the panel may be secured to the footing or foundation by simply toenailing the top of the panel to a plate or soffit or other suitably available member. In one embodiment of the invention the panel is used as the pouring form and a downward directed lip which projects into the poured concrete serves to join the top of the panel to the top of the footing or foundation.

Back filling against the insulated foundation or footing serves to further press the panel against the wall and to support and hold the panel in place. The protective shield is configured so that the lower portion of the shield is at least several inches below grade when back filling is completed. The shield thereby protects the insulating sheet from solar degradation and mechanical damage and direct exposure to the elements above ground and from mechanical damage and the like below ground particularly in the first few inches below ground where most mechanical damage is likely to occur. The lower portion of the sheet of insulation need not be provided with a shield in that it has been found that insulating materials such as expanded polystyrene and the like are very durable when they are shielded from solar radiation and mechanical damage as they would be when buried at least several inches below the ground against a foundation wall.

DETAILED DESCRIPTION OF THE INVENTION

Figure 1:
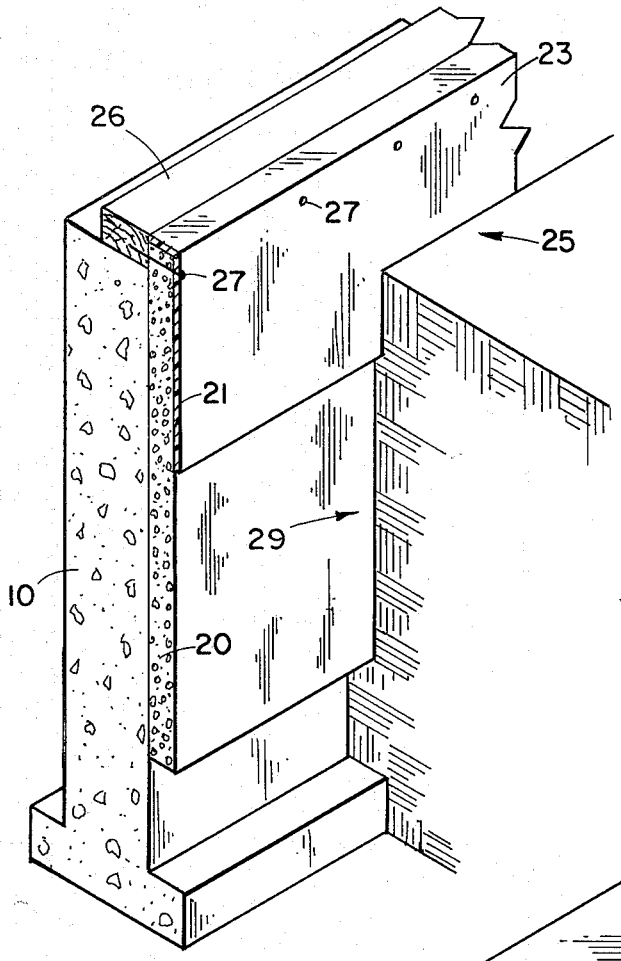
FIG. 1 is a partially sectioned pictorial view of a basement wall having a panel made according to this invention.

Referring now to FIG. 1. Basement wall 10 is provided with insulating sheet 20 having shield 21. Sheet 20 is a sheet of conventional expanded polystyrene insulation or the like. Expanded polystyrene sheets have shown thereselves to be durable and reliable when buried below ground far enough to shield them from solar rays and mechanical damage. Shield 21 as shown in FIG. 1 is coextensive with the exposed above ground surfaces of sheet 20 and to extend at least 4 inches below grade. Shield 21 serves to protect insulating sheet 20 from solar rays and from mechanical damage. Shield 21 is preferably of pultruded fiberglass construction. Pultruding is a continuous process of forming profiles of reinforced fiberglass. As such it permits the continuous forming of a shield of any desired length. Such continuity is, of course, highly desirable in barriers or shields such as shield 21. The fiberglass and expanded polystyrene panel may be readily cut to permit the fitting of the panel around pipes, vents and other protrusions or irregularities in the footing or foundation. Fiberglass shields may be conveniently seamed or patched in place which are additional merits which accrue to a shield formed from a pultruded fiberglass profile.

Top portion 23 of panel 25 which comprises sheet 20 and shield 21 is attached to plate 26 by means of nails 27. The securement of the top of panel 25 to the structure may be by any suitable and convenient means. Sheet 20 may be adhesively joined to shield 21 to form panel 25. Said joining may be done at the time of manufacture or at the construction site. Earth 29 is back filled against the insulated wall so as to cover at least the bottom 4 inches of shield 21 thereby further securing panel 25 in place.

Panel 25 will serve new and existing constructions. The economy of pultruded shield 21 and expanded polystyrene sheet 20 and the simplicity of manufacture and use of panel 25 make this embodiment of the invention a preferred embodiment.

Figure 2:
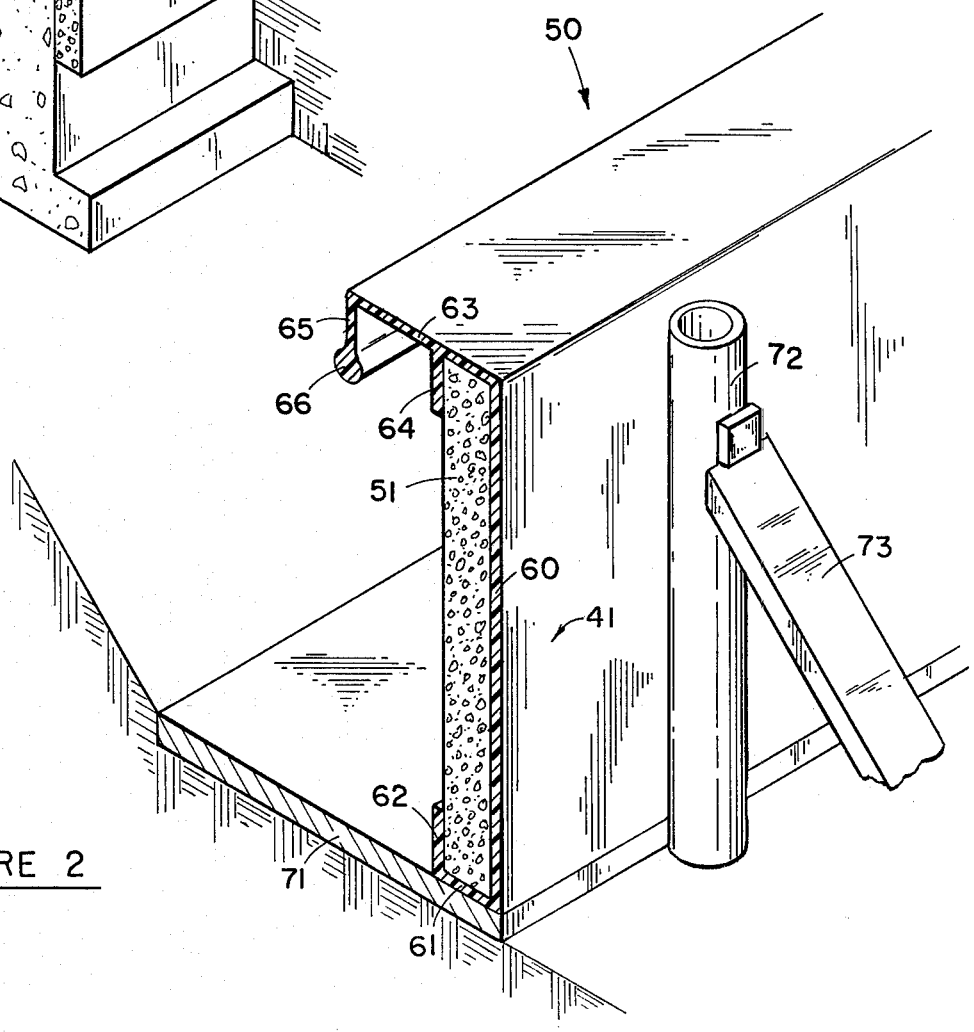
FIG. 2 is a partially sectioned pictorial view of a second embodiment of the panel of this invention as it would appear prior to the pouring of the footing and slab.
Figure 3:
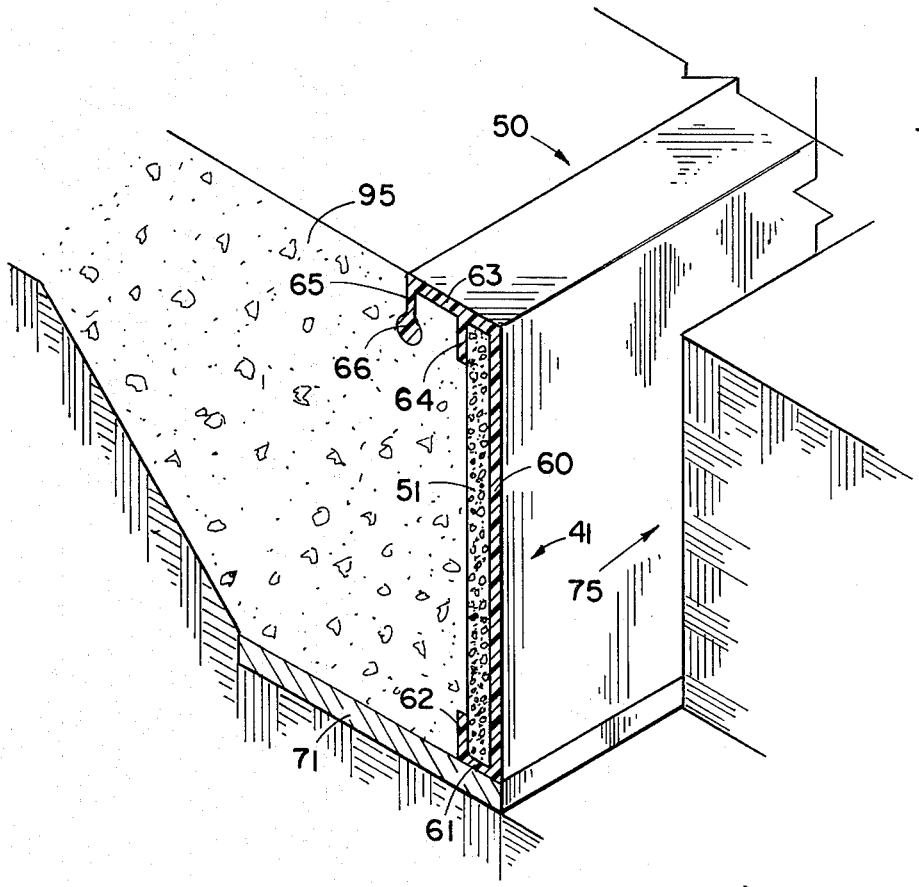
FIG. 3 is a partially sectioned view of a footing for a floating slab having the embodiment of FIG. 2 of the panel of this invention as a part thereof.

Referring now to FIGS. 2 and 3. The embodiment of the invention as illustrated in FIGS. 2 and 3 is intended for use in constructions in general and for the pouring and insulating of footings for floating slab constructions in particular.

Panel 50 while possessing the properties and benefits of panel 25 of FIG. 1 provides the additional novelty of serving both as pouring form and insulating skirt and thereby providing benefits to both the builder and the owner of the construction.

In conventional constructions of this sort, the footings are formed, then poured, the forms are then removed and the footing is insulated as described earlier in this specification. By using the panel of this invention as the form for pouring the steps of removing the forms and insulating the footings are eliminated. Substantial savings in labor and time are thus realized in addition to eliminating the costs of buying, maintaining, and storing reusable forms.

FIG. 2 shows panel 50 in position as a pouring form for a footing in a floating slab construction. Shield 41 has a vertical face 60 a bottom horizontal flange 61 having an upward directed lip 62 and a top horizontal flange 63 which is longer than bottom horizontal flange 61 and top horizontal flange 63 has a downward directed lip 64 which is opposite of lip 62 and horizontal flange 63 is terminated by a second downward directed lip 65 which has an enlarged end portion 66. Face 60, horizontal flanges 61 and 63, and lips 62 and 64 form the perimeter of a channel which slidably receives and retains insulating sheet 51 which is similar to sheet 20 of FIG. 1.

When serving as a pouring form panel 50 rests upon an insulating sheet 71, not a part of this invention. Panel 50 is supported by stakes 72 and brace 73 placed at intervals along the perimeter of the form.

FIG. 3 illustrates the finished construction with stakes 72 and braces 73 removed and earth 75 backfilled against panel 50. It should be noted that lip 65 is embedded in cement 95 and secured there by enlarged tip 66 and panel 50 is thereby made an integral part of the poured construction.

Figure 4:
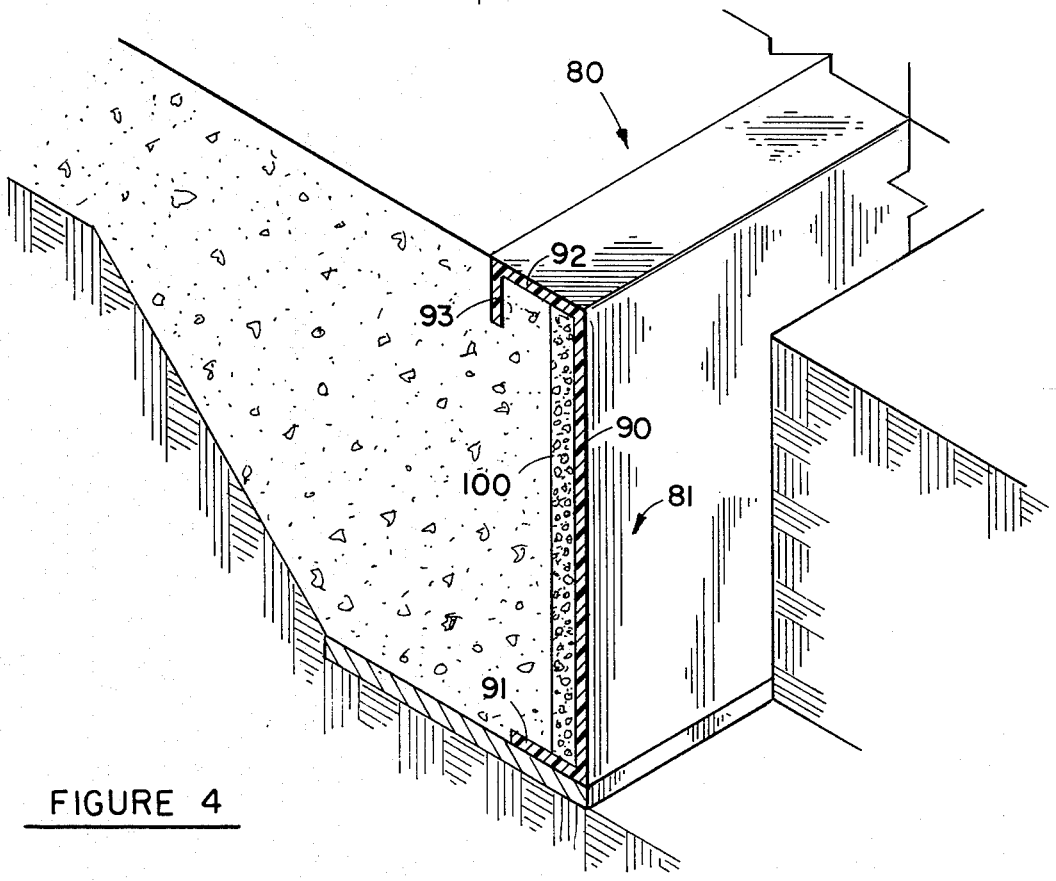
FIG. 4 is a partially sectioned pictorial view of another embodiment of this invention illustrating a simplified shield construction.

Referring now to FIG. 4. Panel 80 has shield 81 having vertical face 90, bottom horizontal flange 91 and top horizontal flange 92 having a downward directed lip 93, and an insulating sheet 100 which is coextensive with vertical face 90. Sheet 100 may be tacked adhesively to vertical face 90 prior to pouring for the purpose of maintaining sheet 100 in position during the preparation of the forms for pouring. After pouring, panel 80 becomes an integral part of the footing. The profile of shield 81 lends itself to the pultruding process as described above.

While two preferred embodiments of the invention have been disclosed in detail herein there are many variants of the invention which will be made obvious to one skilled in the art by this disclosure and which have not been discussed herein. Full treatment of the variants would cause the specifications, drawings, and claims to become prolix. Therefore it should be understood that the scope of the invention should be limited only by the appended claims and all equivalents thereto which would become obvious to one skilled in the art.

I claim:

1. A panel for an insulating skirt for use in insulating the outer perimeters of foundations and footings comprising;

(a) a sheet of substantially rigid and liquid impervious insulating material which is substantially rectangular in shape, and (b) an outer protective shield for said insulating material said shield being of durable reinforced fiberglass material which is seamable and patchable in place to provide means for the establishment and maintenance of a substantially continuous and uniform shield for the outside perimeter of an insulating skirt for a foundation and the like and which is substantially unaffected by the elements present in the vicinity of said foundations and footings and configured so as to be coextensive with those portions of the insulating material which will be exposed and above grade in a finished construction and the outer protective shield further being configured so as to be coextensive with at least the upper portion of the insulating material which is to be below grade in the finished construction and (c) the sheet of insulating material and the protective shield are joined together, and (d) an upper portion of the panel is fabricated so as to permit the substantially permanent securement of the upper portion of the panel to upper elements of a foundation, footing or the like and wherein the panel is to serve as a pouring form for footings, foundations, and the like and the shield has a vertical face having a top edge and a bottom edge and the bottom edge has a bottom horizontal flange projecting therefrom and the flange is terminated by a upward directed lip and the top edge has a top horizontal flange projecting therefrom in the same direction as the bottom horizontal flange and the top horizontal flange extends further from the vertical face than does the bottom horizontal flange and the top horizontal flange has projecting therefrom a first downward directed lip which is opposite the upward lip of the bottom horizontal flange and the top horizontal flange is terminated by a second downward directed lip having an enlarged end which becomes imbedded in cement after it is poured and thereafter substantially permanently locks the panel into engagement with the hardened cement; and the insulating sheet is sized so as to be slidably received by and retained in the channel formed by the vertical face, the top horizontal flange, the bottom horizontal flange, the upward directed lip and the first downward directed lip of the top horizontal flange.

2. The panel of claim 1 wherein the sheet of insulating material is expanded polystyrene and the like and the protective shield is formed by continuously pultruding a fiberglass profile.

3. In a foundation structure having an outside perimeter, and an above grade and a below grade section, an insulating skirt positioned on the foundation structure around the outside perimeter of the foundation structure and being substantially continuous around the perimeter above and below grade and comprising;

an outer shield which is substantially continuous around the outer perimeter both above grade and below grade of a foundation, footing and the like and rigid substantially rectangular panels of insulating material such as expanded polystyrene and the like disposed between the shield and the foundation, footing and the like and the skirt is characterized by a continuously formed shield of reinforced fiberglass having a vertical substantially planar surface having a top edge, a bottom edge, and two vertical edges and the top edge is terminated by at least a short substantially horizontal flange and the rigid panels of insulating material are joined to the shield so that an edge of the insulating material is adjacent to the flange of the shield and the shield is cut to desired lengths, for example the lengths of straight line segments of a foundation, footing and the like and the lengths are secured in the positions they will occupy substantially for the life of the structure, each length of the shield being adjacent to similar lengths of a shield corresponding to the lengths of adjacent walls of the foundation, footing, and the like and adjacent vertical edges of the shield are seamed to each other by conventional fiberglass seaming means to provide a shield which is continuous around the perimeter of the foundation, footing, and the like and when earth is backfilled in the conventional way against the foundation, footing and the like the shield for the insulating skirt is continuous above and below the finished grade.

4. The insulating skirt of claim 3 wherein the shield is formed by continuously pultruding a fiberglass profile.

* * * * *